US009131313B1

(12) United States Patent
Thompson

(10) Patent No.: US 9,131,313 B1
(45) Date of Patent: Sep. 8, 2015

(54) SYSTEM AND METHOD FOR AUDIO REPRODUCTION

(71) Applicant: STAR CO, Longview, TX (US)

(72) Inventor: Evan J. Thompson, Longview, TX (US)

(73) Assignee: Star Co., Longview, TX (US)

( * ) Notice: Subject to any disclaimer, the term of this patent is extended or adjusted under 35 U.S.C. 154(b) by 251 days.

(21) Appl. No.: 13/762,268

(22) Filed: Feb. 7, 2013

Related U.S. Application Data

(60) Provisional application No. 61/596,196, filed on Feb. 7, 2012.

(51) Int. Cl.
*H04R 3/12* (2006.01)

(52) U.S. Cl.
CPC ..... *H04R 3/12* (2013.01)

(58) Field of Classification Search
CPC ..... H04R 3/12
USPC ..... 381/1, 2, 57, 61, 63, 97, 102, 119, 309; 700/94; 327/551; 348/607; 358/167; 375/140, 232, 259, 260, 346; 455/67.11; 708/631
See application file for complete search history.

(56) References Cited

U.S. PATENT DOCUMENTS 4,293,736 A * 10/1981 Ogita ..... 381/4
4,441,192 A * 4/1984 Kita et al. ..... 375/232
5,268,760 A * 12/1993 Suyama ..... 348/624
5,285,277 A * 2/1994 Min ..... 348/607
5,930,375 A * 7/1999 East et al. ..... 381/119
6,011,430 A * 1/2000 Kim ..... 327/551
6,385,261 B1 * 5/2002 Tsuji et al. ..... 375/346
6,546,041 B1 * 4/2003 Fujimoto ..... 375/140
7,151,573 B2 * 12/2006 Kim et al. ..... 348/607
7,382,888 B2 * 6/2008 Aylward et al. ..... 381/97
7,583,738 B2 * 9/2009 Yun et al. ..... 375/260
7,583,805 B2 * 9/2009 Baumgarte et al. ..... 381/61
7,822,210 B2 * 10/2010 Barnhill ..... 381/2
8,238,590 B2 * 8/2012 Burge ..... 381/309
8,363,843 B2 * 1/2013 Diedrichsen ..... 381/63
8,385,399 B2 * 2/2013 Yang et al. ..... 375/232
8,472,574 B2 * 6/2013 Asjadi ..... 375/346
8,521,314 B2 * 8/2013 Seefeldt et al. ..... 700/94
8,705,753 B2 * 4/2014 Haulick et al. ..... 381/57
8,743,976 B2 * 6/2014 Smith et al. ..... 375/259
8,774,425 B2 * 7/2014 Yu et al. ..... 381/102
2011/0261966 A1 * 10/2011 Engdegard ..... 381/1
2012/0077444 A1 * 3/2012 McMeekin et al. ..... 455/67.11

* cited by examiner

*Primary Examiner* — Gerald Gauthier
(74) *Attorney, Agent, or Firm* — McAndrews, Held & Malloy, Ltd.

(57) ABSTRACT

Systems and methods of audio reproduction are described. In one embodiment, one or more processors can be configured, for example, to receive an L channel signal and an R channel signal, to combine the L channel signal and the R channel signal, to average the combined signal, to detect an impulse signal in the averaged signal, to multiply the impulse signal, to scale the multiplied impulse signal, and to add the scaled impulse signal to the averaged signal to form a resultant signal. Sound can be generated, for example, by speakers based on at least the resultant signal.

20 Claims, 4 Drawing Sheets

SYSTEM AND METHOD FOR AUDIO REPRODUCTION

CROSS-REFERENCE TO RELATED APPLICATIONS/INCORPORATION BY REFERENCE

The present application makes reference to, claims priority to and claims benefit from U.S. Application No. 61/596,196, filed Feb. 7, 2012. The above-referenced application is hereby incorporated herein by reference in its entirety.

FIELD OF THE DISCLOSURE

Some aspects of some embodiments of the present disclosure may relate to systems and methods for audio reproduction.

BACKGROUND OF THE DISCLOSURE

Conventional attempts to improve the subwoofer response of audio systems include reducing the weight of the speaker driver (e.g., a cone). By reducing the mass that must be pushed by the driver's magnetic field, the cone can travel back and forth faster. Such a design accomplishes a very limited boost in impulse response, but requires expensive materials to construct a strong, yet lightweight cone for use in producing large impulses.

Other conventional attempts to improve the subwoofer response of audio systems include increasing the treble frequencies of an incoming audio signal. Such a design accomplishes a very limited amount of "punch" in a larger driver, but produces many unwanted frequencies in the subwoofer driver, thereby reducing overall sound production quality.

Further limitations and disadvantages of conventional and traditional approaches will become apparent to one of skill in the art through the comparison of such systems with some aspects of some embodiments according to the present disclosure as set forth in the remainder of the present application with reference to the drawings.

BRIEF SUMMARY OF THE DISCLOSURE

Some aspects of some embodiments according to the present disclosure may relate to, for example, systems and methods of audio reproduction. For example, one or more processors are configured to receive an L channel signal and an R channel signal, combine the L channel signal and the R channel signal, average the combined signal, detect an impulse signal in the averaged signal, multiply the impulse signal, scale the multiplied signal and add the scaled signal to the averaged signal to form a resultant signal. Sound can be generated, for example, by one or more speakers based on at least the resultant signal.

These and other advantages, aspects and novel features of the present disclosure, as well as details of an illustrated embodiment thereof, will be more fully understood from the following description and drawings.

DETAILED DESCRIPTION OF THE DISCLOSURE

Figure 1:
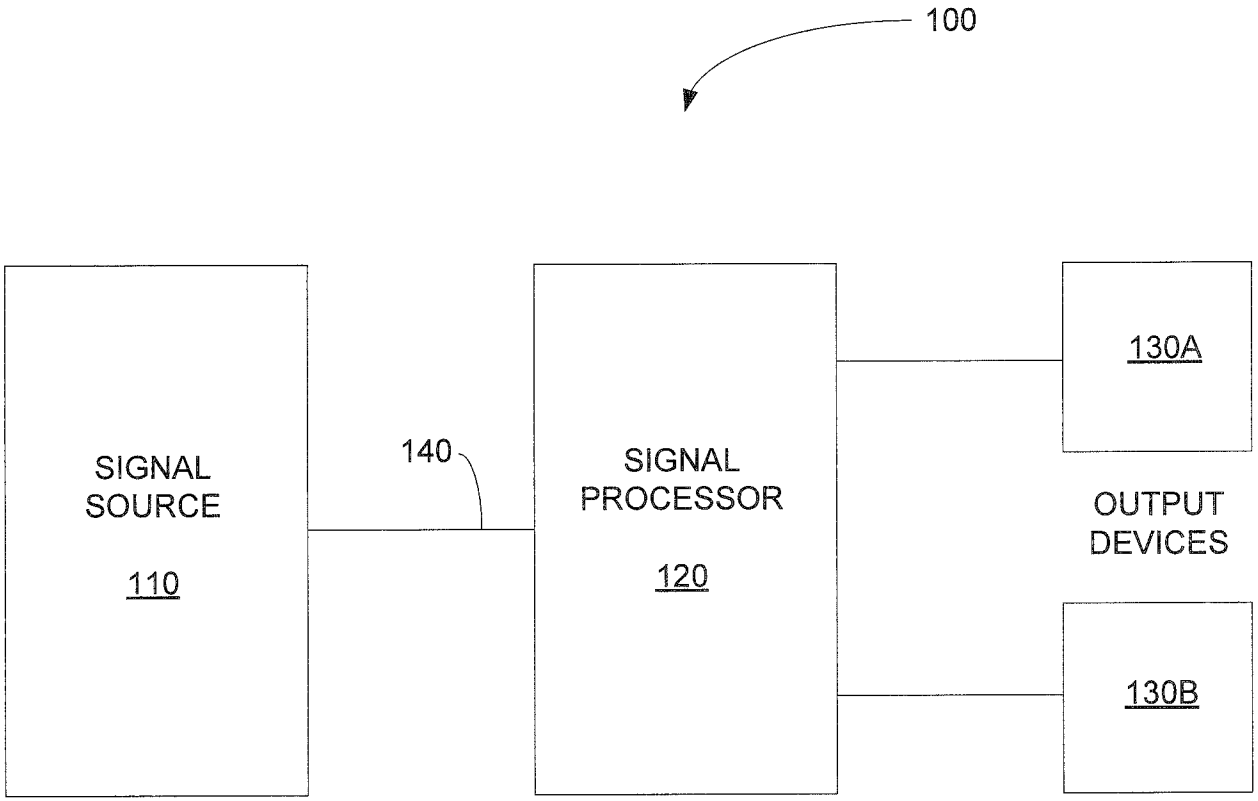
FIG. 1 is a block diagram of an audio reproduction system according to an embodiment of the present disclosure.

Some aspects of some embodiments according to the present disclosure may relate to systems and methods of audio reproduction, for example. Some aspects of some embodiments according to the present disclosure may relate to systems and methods for digital audio fidelity enhancement, for example. Some aspects of some embodiments according to the present disclosure may relate to systems and methods for soundstage production.

Some aspects of some embodiments according to the present disclosure may relate to, for example, systems and methods of audio reproduction. For example, one or more circuits can be configured, for example, to receive an L channel signal, an R channel signal and, if present, the LR channel signal and other channel signals (e.g., other home entertainment channels and/or signals) and to filter the signals to a frequency band of interest (e.g., a subwoofer frequency band). The one or more circuits can be configured to combine the channel signals and to average the combined signal. Impulse signals in the averaged signal can be detected, multiplied and/or scaled. In some embodiments according to the present disclosure, the detected, multiplied and/or scaled impulse signals can be the bass notes or percussion sounds that are desired to be accentuated. The one or more circuits can be configured, for example, to add the detected, multiplied and/or scaled impulse signals with the averaged signal resulting in a resultant signal. Sound can be generated, for example, by speakers based on at least the resultant signal.

Some embodiments according to the present disclosure can provide, for example, suitable logic, circuitry, code or combinations thereof that can be adapted to perform the functions or acts described herein.

Some embodiments according to the present disclosure employ a digital filter that compensates for an audio device's large inertia (e.g., a subwoofer driver's large inertia).

Some embodiments according to the present disclosure receive an incoming audio signal and process the audio signal to emphasize impulses (e.g., large impulses) that are used in driving subwoofer systems. In low frequency speakers, such emphasized impulses can add a "punch" to the received audio signal according to some embodiments of the present disclosure.

Some embodiments according to the present disclosure provide a digital-based solution, resulting in a powerful, adaptive filter design.

Some embodiments according to the present disclosure provide an adaptive digital filter that finds impulse signals in audio signal and amplifies them without adding excess noise to the rest of the audio signal. Other designs might focus only on changing the speaker or only using passive equalization, however, some embodiments according to the present disclosure provide a more targeted and effective manipulation of the audio signal.

Some embodiments according to the present disclosure provide as an output a main audio stream (e.g., an unaltered main audio stream) while providing a separate, processed low-frequency output specifically for a subwoofer. Some embodiments according to the present disclosure are not limited to only providing a separate, processed low-frequency output, but can be adapted to provide a processed output for a selected frequency band. Thus, for example, the processed output might be a particular frequency band that is used for dedicated high-frequency speakers.

Some embodiments according to the present disclosure provide for a single-board system, a single chip system, a system on a chip or a system on an integrated circuit.

Some embodiments according to the present disclosure provide for adaptations based on, for example, user inputs via dials, buttons, knobs, keyboards, mice, and other user input devices. Such user inputs can be used to set thresholds, select frequency bands, tweak system sensitivities and/or other variables or parameters.

Some embodiments according to the present disclosure can be cost effective and can apply to existing or future speaker systems. By intercepting main audio streams, a low-frequency input and/or a combination thereof and processing those separately while allowing the main speakers to remain untouched, an effective low-frequency output can easily be added to an audio system and/or an existing subwoofer can be enhanced by this system according to some embodiments of the present disclosure.

FIG. 1 is a block diagram of an audio reproduction system 100 according to an embodiment of the present disclosure. The audio reproduction system 100 can include, for example, a signal source 110 that is connected to a signal processor 120 which, in turn, is connected to one or more output devices 130.

The signal source 110 can be, for example, the source of audio signals and other signals. The signal source 110 might be, for example, a radio, a car stereo, a CD player, a tape player, an audio recorder, a video recorder, a music player, a DVD player, a portable media player, a media player, a video player, a computer system, a microphone, a television, a satellite receiver, a cable television receiver, a network device, a movie player, a home theater system, etc. The signal source 110 can be configured, for example, to provide a plurality of audio channel including, for example, a left (L) channel, a right (R) channel, a low frequency (LF) channel and other channels (e.g., other audio channels). The plurality of audio channels can be provided to the signal processor 120 over one or more connections 140.

The signal processor 120 can be configured, for example, to receive the plurality of audio channels, to combine the plurality of audio channels, to detect impulses in a particular range of frequencies, and to accentuate the detected impulses before adding the accentuate impulses back into the combined audio channels. The resultant signal of adding the accentuated impulses and the combined audio channels can be provided to one or more output devices 130.

In some embodiments according to the present disclosure, output device 130A might be, for example, one or more subwoofers that receive the resultant signal from the signal processor 120. The output device 130A might be dedicated to reproduce, for example, low frequency audio frequencies (e.g., bass frequencies). The low frequency audio output of the output device 130A based on the resultant signal would have extra emphasis on, for example, bass notes or percussion sounds. Some embodiments according to the present disclosure provide that the bass notes or percussion sounds, for example, are "pounded" instead of merely "woofed." In addition, the audio signals in other frequency bands would not substantially be affected according to some embodiments of the present disclosure. Furthermore, in some embodiments according to the present disclosure, some audio signals in the particular range of low frequencies, for example, would not be accentuated unless the audio signals were part of the detected impulse.

Although not limited to any particular frequency range, some embodiments according to the present disclosure are configured to detect impulses in the frequency range of approximately 20 Hz to approximately 200 Hz. Some embodiments according to the present disclosure are configured to detect impulses in the frequency range under approximately 100 Hz or under approximately 80 Hz.

Some embodiments according to the present disclosure might provide that the output device 130A includes one or more speakers that reproduce a wide range of frequency ranges including a frequency range attributable to a subwoofer.

The other output devices 130B can include, for example, other speakers that reproduce audio signals in other frequency ranges (e.g., above frequency ranges attributable to a subwoofer), audio-visual displays, etc. Some embodiments according to the present disclosure provide that the signal processor 120 need not be limited to processing only audio signals, but can also process video signals and/or data signals. In addition, the signal processor 120 need not be limited to processing only audio signals in frequency ranges associated with a subwoofer, but can also process other frequency ranges (e.g., high frequency ranges) for other types of speakers.

The signal processor 120 can include, for example, one or more of the following: a processor, a digital filter, a microprocessor, a digital processor, a microcontroller, a programmable array logic device, a complex programmable logic device, a field-programmable gate array and an application specific integrated circuit, and a memory. Code, instructions, software, firmware and/or data can be stored in the signal processor 120.

The memory can include, for example, one or more of the following: a non-transitory memory, a non-transitory processor readable medium, a non-transitory computer readable medium, a read only memory (ROM), a random access memory (RAM), a cache, a semiconductor memory, a flash memory, a memory card, a removable memory, etc. The memory 190 can be configured to store code, instructions, software, firmware and/or data for use and/or executable by the signal processor 120 and can be external to the signal processor 120. The memory can be part of the signal processor 120 or operatively coupled to the signal processor 120 via, for example, one or more wires or buses.

Some of the code, instructions, software, firmware and/or data can be hardwired (e.g., hardware implementations, hardwired into registers, etc.) and/or can be programmable according to some embodiments of the present disclosure.

Figure 2:
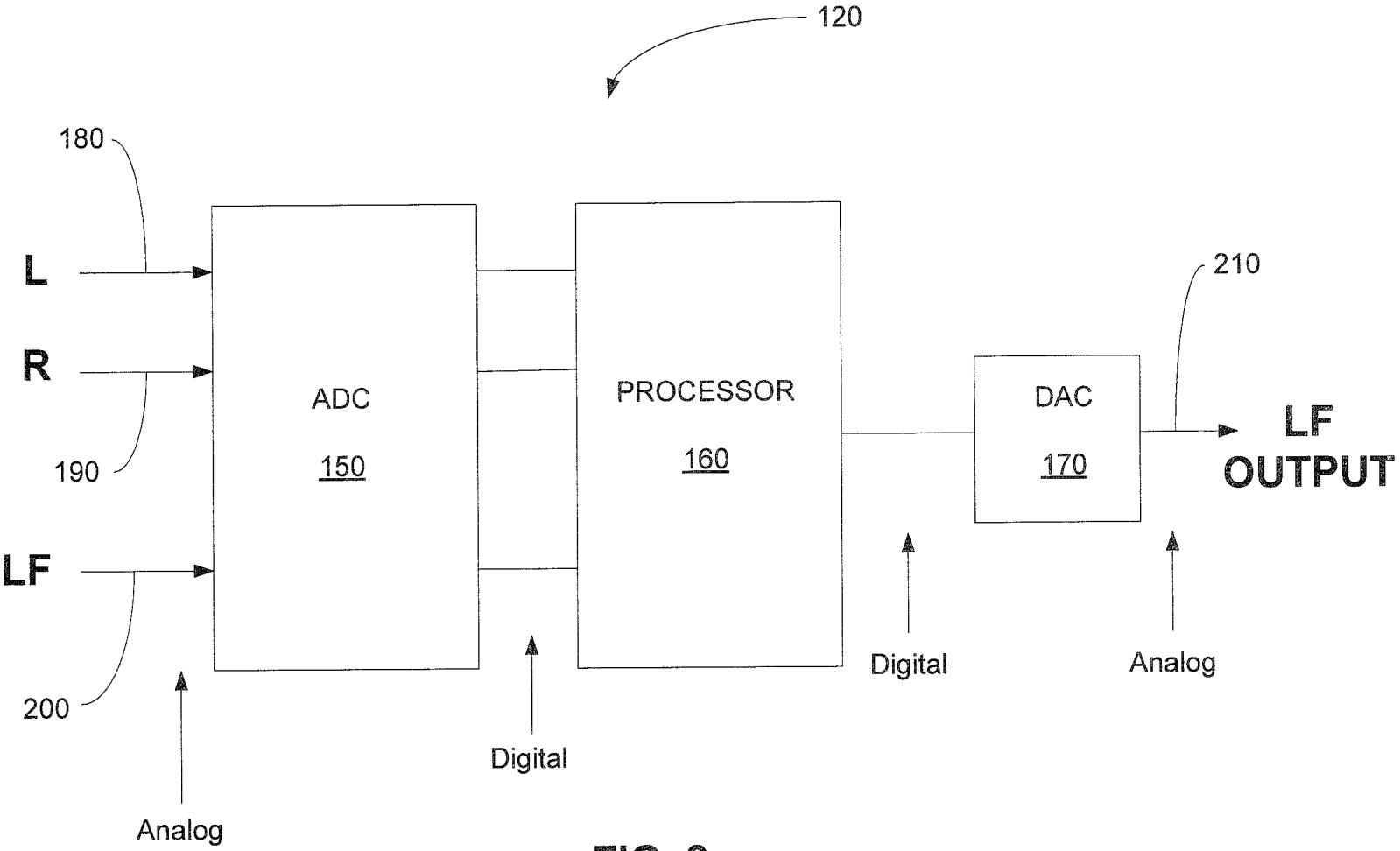
FIG. 2 is a block diagram of the signal processor according to an embodiment of the present disclosure.

FIG. 2 is a block diagram of the signal processor 120 according to an embodiment of the present disclosure. The signal processor 120 can include, for example, an analog-to-digital converter (ADC) 150, one or more processors 160 and a digital-to-analog converter (DAC) 170. The ADC 150 and/or the DAC 170 can be internal or external with respect to the signal processor 120. In addition, although the ADC 150 is illustrated as a single ADC 150, the ADC 150 can be a plurality of ADCs. For example, each channel can have its own ADC 150.

The ADC 150 is illustrated as having three inputs 180, 190, 200 and three outputs. However, the number of inputs and outputs can vary without departing from the scope of some of the embodiments of the present disclosure. As illustrated in FIG. 2, the ADC 150 has an input 180 for receiving L channel signals, an input 190 for receiving R channel signals and an input 200 for receiving LF channel signals. Some embodiments according to the present disclosure do not use the LF channel signals or the LF channel signals might not be present. The ADC 150 converts the L channel signals, the R channel signals and the LF channel signals from analog signals into digital signals.

The processor 160 is illustrated as having three inputs and an output. However, the number of inputs and outputs can vary without departing from the scope of some of the embodiments of the present disclosure. One of the inputs of the processor 160 receives the digital L channel signals, another of the inputs receives the digital R channel signals and yet another of the inputs receives the digital LF channel signals.

The processor 160 can include, for example, one or more of the following: a microprocessor, a digital filter, a digital processor, a microcontroller, a programmable array logic device, a complex programmable logic device, a field-programmable gate array and an application specific integrated circuit, and a memory.

The processor 160 is configured to perform, for example, one or more of the following: to receive and to filter (e.g., low pass filter) the digital L channel signal, the digital R channel signal and the digital LF channel signal, if present; to combine the digital L channel signal, the digital R channel signal and the digital LF channel signal, if present; to average the combined signal; to detect an impulse signal in the averaged signal; to multiply the detected impulse signal; to scale the multiplied signal; and to add the scaled impulse signal back into the averaged signal.

The resultant signal based on the addition of the scaled impulse signal back and the averaged signal is output by the processor 160 to the DAC 170. The DAC 170 converts the resultant signal from a digital signal to an analog signal, which can be used as an LF channel signal output (e.g., a line-level output). The LF channel signal output can be used to generate low-frequency audio in, for example, a subwoofer, a woofer and/or other audio output devices (e.g., a loud speaker).

Figure 3:
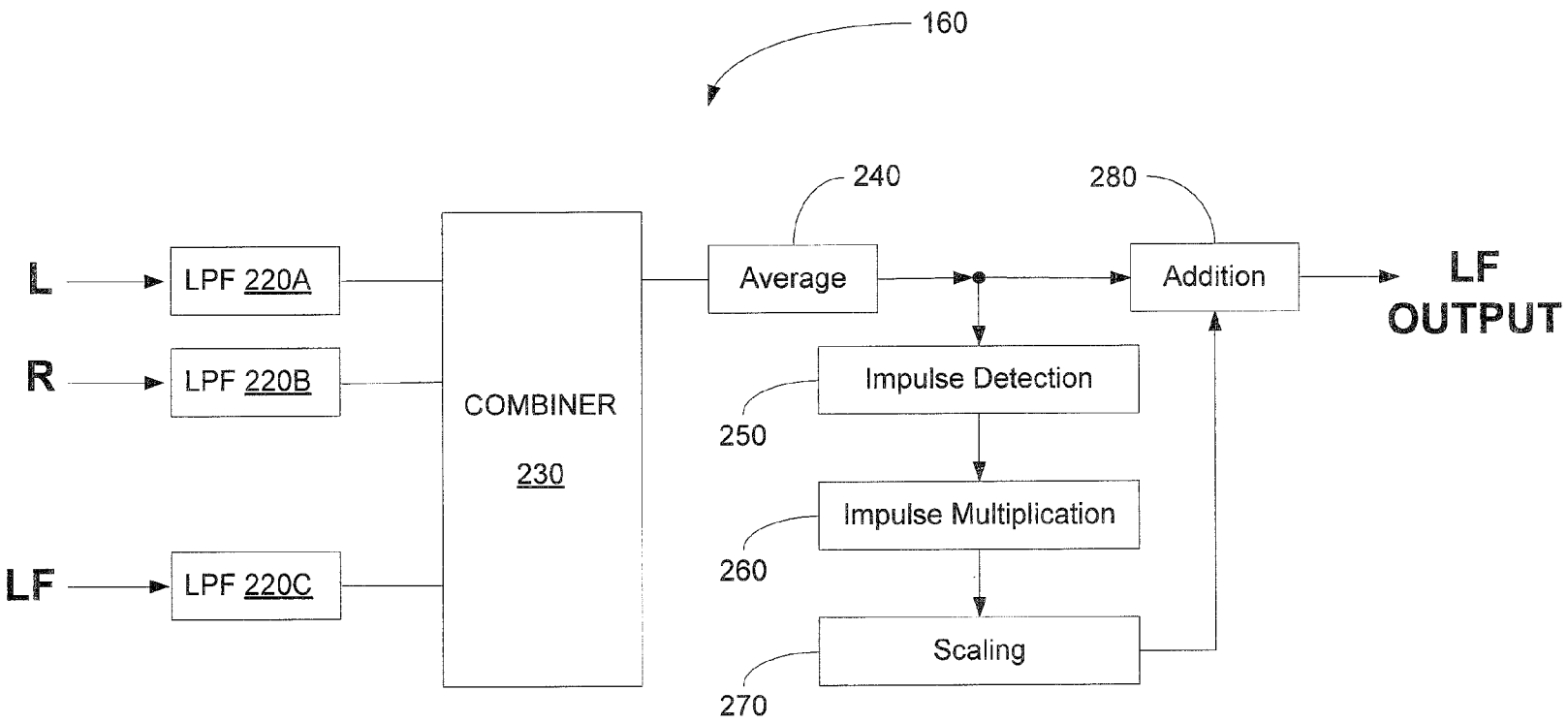
FIG. 3 is a block diagram of a processor according to an embodiment of the present disclosure.

FIG. 3 is a block diagram of the processor 160 according to an embodiment of the present disclosure. The various components illustrated in FIG. 3, for example, can include suitable logic, circuitry, code or combinations thereof that can be adapted to perform the described functions. In addition, although illustrated as various components, some embodiments according to the present disclosure contemplate varying degrees of integration of various components.

In an embodiment according to the present disclosure as illustrated in FIG. 3, the L channel signals, the R channel signals and the LF channel signals, if present, are received by low pass filters 220 of the processor 160. The filtered signals are combined by the combiner 230. The combined signals are then averaged.

Some embodiments according to the present disclosure provide for a sampler and a buffer as part of an averager 240. The sampler can be configured, for example, to sample the combined signals and to store the sample combined signals in the buffer. The averager 240 can be configured, for example, to average the contents of the buffer and to output an averaged signal. In some embodiments according to the present disclosure, the averaged signal is an averaged digital audio stream. Some embodiments according to the present disclosure contemplate other types of averaging including, for example, running averages, averages in time, weighted averages, etc. The averaged signal is sent to an adder 280 and/or to an impulse detector 250.

Some embodiments according to the present disclosure use low pass filters 220 to focus on low frequencies elements of the audio signal. However, the low pass filtering can cause degradation of the impulses that are used to drive subwoofer systems, for example, by smoothing out in time the impulse signal. As an example, a square impulse in time can lose the sharp front edge and/or the sharp back edge of the square impulse when low pass filtered. The low pass filtered impulse effectively loses its punch when used to drive subwoofer systems, for example. Some embodiments contemplate that one or more of the impulse detector 250, the impulse multiplier 260, the scaler 270 and the adder 280 can make up for or compensate for the lost punch in the low pass filtered impulse by adding an audio signal that at least substantially restores and possibly accentuates the sharp front and/or back edges of the square impulse, for example.

The impulse detector 250 detects impulses in the averaged signal. Some embodiments according to the present invention contemplate that the impulse detector 250 implement a fast Fourier Transform (FFT) and analyze the spectral elements to determine where the impulse energy is spectrally located. In some embodiments according to the present disclosure, the impulse can represent, for example, bass notes or percussion sounds in the particular frequency range of interest. Some embodiments according to the present disclosure provide that the impulse detector 250 detects impulses by detecting, for example, substantial changes in the averaged signal.

The detected change can then be multiplied by the impulse multiplier 260 and scaled by the scaler 270 based on, for example, user inputs, parameters (e.g., programmable parameters), previously detected impulses and/or previously detected changes. Some embodiments according to the present disclosure provide that the detected change is multiplied and scaled based on at least previous impulse changes, for example.

Some embodiments increase the amplitude of the averaged signal at the portions of the impulse signal that have been smoothed in time. Thus, the multiplication (e.g., increasing the amplitude of the signal) can occur during a short time period that is near, for example, the front or back edge of the impulse signal. In some embodiments, the period of time for multiplication is small compared to the impulse duration in time. The scaling then stretches the multiplied signal in time to make up for or to compensate for the smoothing in time of the impulse signal, for example, due to the filtering.

Some embodiments contemplate that the characteristics (e.g., cut off frequency) of the low pass filters 220 can be used to determine the magnitude of multiplication and/or the period of time over which the signal is multiplied or scaled.

The scaled and multiplied signal is added by the adder 280 to the averaged signal from the averager 240. In some embodiments, the addition of the scaled and multiplied signal to the averaged signal brings back, restores or emphasizes the impulse signals. The resultant signal of the added signals is passed through the DAC 170. The DAC 170 converts the resultant signal from a digital signal to an analog signal, which can be used as an LF channel signal output (e.g., a line-level output). The LF channel signal output can be used to generate low-frequency audio in a subwoofer, for example.

Figure 4:
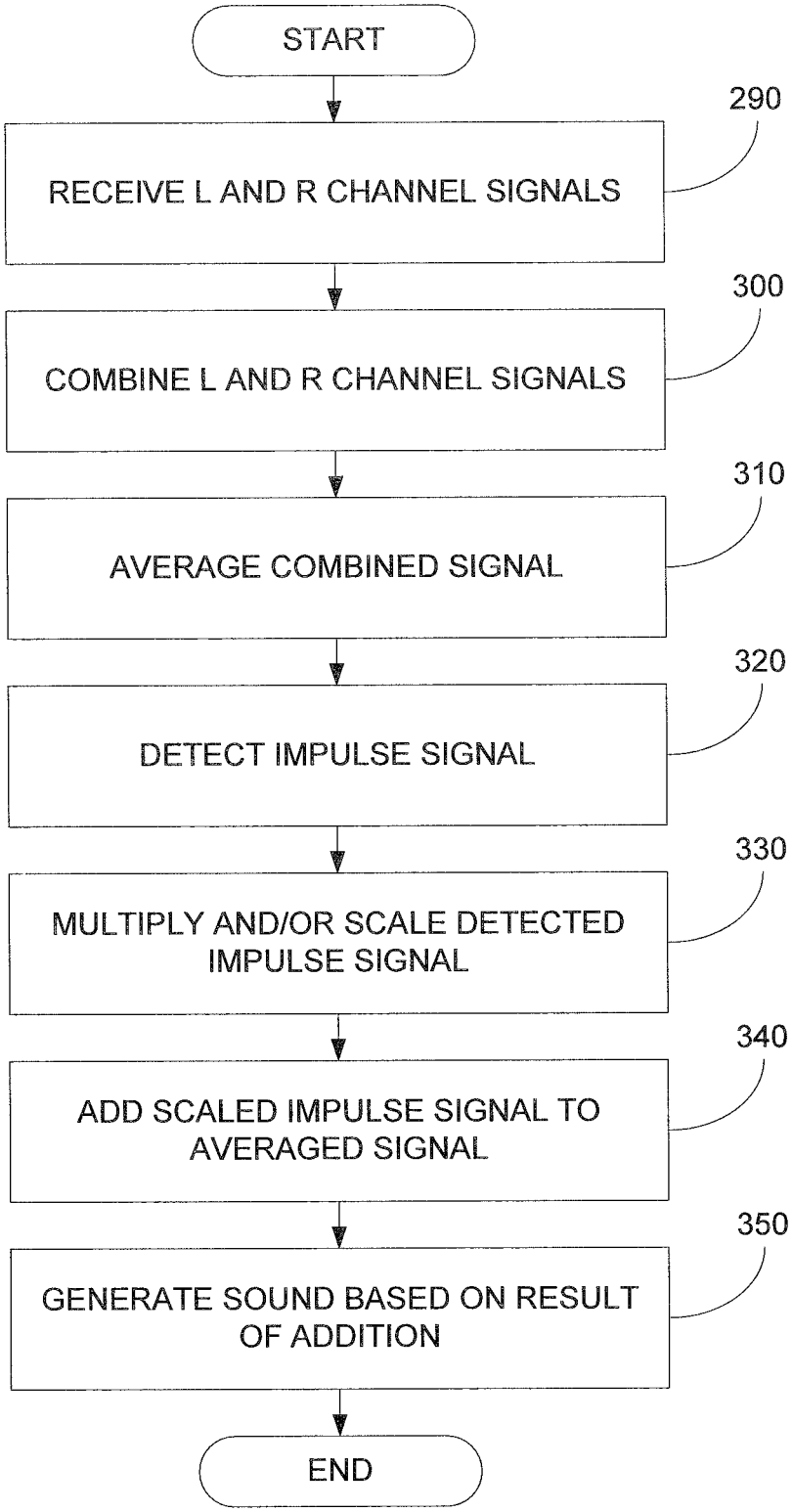
FIG. 4 is a flow diagram of a process of audio reproduction according to an embodiment of the present disclosure.

FIG. 4 is a flow diagram of an embodiment according to the present disclosure. The steps in the flow diagram can be performed, at least in part, by the signal processor 120 and/or the processor 160. For example, the signal processor 120 and/or the processor 160 can be configured to perform steps 290-340 or other subsets of the steps illustrated in FIG. 4. However, the steps need not be limited to being performed by the signal processor 120 and/or the processor 160.

Some embodiments according to the present disclosure provide that suitable logic, circuitry, code or combinations thereof can be adapted to receive the L channel signal and the R channel signals in step 290. If applicable, the LF channel signal is also received. The channel signals can be received separately (e.g., in parallel inputs) or in a combined signal (e.g., a multiple access signal such as a time, code or frequency division multiple access signal). Suitable logic, circuitry, code or combinations thereof can be adapted to filter (e.g., high pass, low pass, band pass and/or notch filter) the received signals.

Suitable logic, circuitry, code or combinations thereof can be adapted to combine the L channel signals, the R channel signals and, if present, the LF channel signals in step 300.

Suitable logic, circuitry, code or combinations thereof can be adapted to average the combined signal in step 310.

Suitable logic, circuitry, code or combinations thereof can be adapted to detect impulse signals in the averaged signals in step 320. In some embodiments according to the present disclosure, the impulse signals can be signal changes that exceed a particular threshold (e.g., a preset threshold, a default threshold, a programmable threshold, a user setting, etc.)

Suitable logic, circuitry, code or combinations thereof can be adapted to multiply and/or scale the detected impulses in step 330.

Suitable logic, circuitry, code or combinations thereof can be adapted to add, in step 340, the multiplied and/or scaled signals (e.g., from step 330) to the averaged signal (e.g., from step 310).

In some embodiments according to the present disclosure, the resultant signal of the addition can then be converted from a digital signal to an analog signal that can be used to generate, in step 350, sound in, for example, a subwoofer, a woofer and/or other audio output devices (e.g., a speaker).

Some aspects of some embodiments according to the present disclosure may relate to, for example, systems and methods of audio reproduction. For example, one or more processors can be configured to receive an L channel signal, an R channel signal and, if present, the LR channel signal and other channel signals (e.g., other home entertainment signals) and to filter the signals to a frequency band of interest (e.g., a subwoofer frequency band). The one or more processors can be configured to combine the channel signals and to average the combined signal. Impulse signals in the averaged signal can be detected, multiplied and/or scaled. In some embodiments according to the present disclosure, the detected, multiplied and/or scaled impulse signals can be the bass notes or percussion sounds that are desired to be accentuated. The one or more processors can be configured, for example, to add the detected, multiplied and/or scaled impulse signals with the averaged signal resulting in a resultant signal. Sound can be generated, for example, by speakers based on at least the resultant signal.

Some embodiments according to the present disclosure can be realized in hardware, software, firmware or a combination of hardware, software or firmware. Some embodiments according to the present disclosure can be realized in a centralized fashion in at least one computer system, or in a distributed fashion where different elements are spread across several interconnected computer systems. Any kind of computer system or other apparatus adapted for carrying out the methods described herein is suited. A typical combination of hardware and software can be a general-purpose computer system with a computer program that, when being loaded and executed, controls the computer system such that it carries out the methods described herein.

Some embodiments according to the present disclosure can also be embedded in a computer program product, which comprises all the features enabling the implementation of the methods described herein, and which when loaded in a computer system is able to carry out these methods. Computer program in the present context means any expression, in any language, code or notation, of a set of instructions intended to cause a system having an information processing capability to perform a particular function either directly or after either or both of the following: (a) conversion to another language, code or notation; and (b) reproduction in a different material form.

While some embodiments according to the present disclosure have been described with reference to certain embodiments, it will be understood by those skilled in the art that various changes can be made and equivalents can be substituted without departing from the scope of the present disclosure. In addition, the present disclosure contemplates that aspects and/or elements from different embodiments can be combined into yet other embodiments according to the present disclosure. Moreover, many modifications can be made to adapt a particular situation or material to the teachings of the present disclosure without departing from its scope. Therefore, it is intended that the present disclosure not be limited to the particular embodiments disclosed, but that the present disclosure will include all embodiments falling within the scope of the appended claims.

What is claimed is:

1. A method of audio reproduction, comprising:

(a) combining, by one or more processors, an L channel signal and an R channel signal;

(b) averaging, by the one or more processors, the combined signal;

(c) detecting, by the one or more processors, an impulse signal in the averaged signal;

(d) multiplying, by the one or more processors, the impulse signal;

(e) scaling, by the one or more processors, the multiplied impulse signal;

(f) combining the scaled portion of the impulse signal to the averaged signal to form a resultant signal; and (g) generating sound, by a speaker, based on the resultant signal.

2. The method according to claim 1, wherein one or more of scaling and multiplying are based on at least user inputs and previously detected impulse signals.

3. The method according to claim 1, wherein (c) comprises detecting a substantial change in the averaged signal.

4. The method according to claim 1, wherein (a) comprises combining the L channel signal, the R channel signal and an LF channel signal.

5. The method according to claim 1, wherein (c) to (f) restores, in time, a sharp front edge or a sharp back edge in the impulse signal.

6. The method of according to claim 1, wherein (d) includes amplifying a first portion of impulse signal, and wherein (e) includes scaling the amplified first portion of the impulse signal over a second portion of the impulse signal.

7. The method according to claim 1, wherein (b) includes sampling the combined signal, and averaging the sampled combined signals.

8. The method according to claim 7, wherein the sampled combined signals are stored in a buffer, and wherein contents of the buffer are averaged.

9. The method according to claim 1, wherein the received L channel signal and the received R channel signal are digital signals.

10. The method according to claim 1, comprising converting the added signal into an analog signal.

11. The method according to claim 1, wherein the L channel signal, the R channel signal, the combined signal, the averaged signal, the scaled signal and the added signal are digital signals.

12. The method according to claim 1, wherein the scaled impulse signal accentuates woofer or subwoofer frequencies in the added signal.

13. A system of audio reproduction, comprising:

one or more processors that are configured to:

receive an L channel signal and an R channel signal, combine the L channel signal and the R channel signal, average the combined signal, detect an impulse signal in the averaged signal, multiply a portion of the detected impulse signal, scale the multiplied portion of the impulse signal, and add the scaled impulse signal to the averaged signal to form a resultant signal, wherein sound is generated based on at least the resultant signal.

14. The system according to claim 13, wherein the portion of the detected impulse signal that is multiplied is amplified over a period of time that is shorter than the impulse signal duration, wherein the period of time occurs at a front edge or a back edge of the impulse signal.

15. The system according to claim 13, wherein the one or more processors are configured to receive the L channel signal, the R channel signal and an LF channel signal, and wherein the one or more processors are configured to combine the L channel signal, the R channel signal and the LF channel signal.

16. The system according to claim 13, wherein the one or more processors multiply, scale and add to overcome a smoothing of a front edge or a back edge of the impulse signal.

17. The system according to claim 16, wherein the smoothing of the front edge or the back edge of the impulse signal occurred due to pass filtering of the impulse signal.

18. The system according to claim 13, wherein the scaled impulse signal accentuates woofer or subwoofer frequencies in the added signal.

19. A signal processor, comprising:

one or more circuits that are configured to:

receive an L channel signal and an R channel signal, combine the L channel signal and the R channel signal, average the combined signal, detect an impulse signal in the averaged signal, multiply the impulse signal, scale the multiplied impulse signal, and add the scaled impulse signal to the averaged signal to form a resultant signal, wherein sound is generated based on at least the resultant signal.

20. The signal processor according to claim 19, wherein the multiplying of the impulse signal occurs over a fraction of the impulse period, and wherein the scaling of the multiplied impulse signal causes the multiplied signal to be stretched over time.

* * * * *